US008308319B2

(12) United States Patent
Kong et al.

(10) Patent No.: US 8,308,319 B2
(45) Date of Patent: Nov. 13, 2012

(54) LIGHTING DEVICE

(75) Inventors: Kyung Il Kong, Seoul (KR); Michael Castelli, Nissequogue, NY (US)

(73) Assignee: LG Innotek Co., Ltd., Seoul (KR)

( * ) Notice: Subject to any disclaimer, the term of this patent is extended or adjusted under 35 U.S.C. 154(b) by 0 days.

(21) Appl. No.: 13/207,972

(22) Filed: Aug. 11, 2011

(65) Prior Publication Data

US 2012/0002416 A1 Jan. 5, 2012

(30) Foreign Application Priority Data

Aug. 11, 2010 (KR) ..... 10-2010-0077280

(51) Int. Cl.
*F21V 1/00* (2006.01)

(52) U.S. Cl. .... 362/235; 362/294; 362/240; 362/249.02

(58) Field of Classification Search ..... 362/235, 362/294, 240, 247, 249.02, 295
See application file for complete search history.

(56) References Cited

U.S. PATENT DOCUMENTS

| | | | | |
|---|---|---|---|---|
| 7,695,162 | B2 * | 4/2010 | Zhang et al. | 362/294 |
| 7,712,927 | B2 * | 5/2010 | Shuai et al. | 362/294 |
| 8,083,375 | B2 * | 12/2011 | Kong | 362/249.02 |
| 2009/0147520 | A1 * | 6/2009 | Liu et al. | 362/294 |
| 2010/0259919 | A1 * | 10/2010 | Khazi et al. | 362/84 |
| 2011/0002124 | A1 * | 1/2011 | Chang et al. | 362/294 |

* cited by examiner

*Primary Examiner* — Evan Dzierzynski
(74) *Attorney, Agent, or Firm* — Lowe Hauptman Ham & Berner, LLP

(57) ABSTRACT

A lighting device includes a light source unit having a substrate and a light emitting diode disposed on the substrate, a heat sink having an inner surface on which the light source unit is disposed and at least one opening, and a top plate being disposed on the heat sink and having a reflective surface which reflects light from the light source unit in a particular direction.

19 Claims, 10 Drawing Sheets

LIGHTING DEVICE

CROSS-REFERENCE TO RELATED APPLICATION

This application claims priority under 35 U.S.C. §119 from Korean Application No. 10-2010-0077280, filed Aug. 11, 2010, the subject matters of which are incorporated herein by reference.

BACKGROUND

1. Field

Embodiments may relate to a lighting device.

2. Background

A light emitting diode (LED) is an energy device for converting electric energy into light energy. Compared with an electric bulb, the LED has higher conversion efficiency, lower power consumption and a longer life span. As there advantages are widely known, more and more attentions are now paid to a lighting apparatus using the LED.

The lighting apparatus using the LED are generally classified into a direct lighting apparatus and an indirect lighting apparatus. The direct lighting apparatus emits light emitted from the LED without changing the path of the light. The indirect lighting apparatus emits light emitted from the LED by changing the path of the light through reflecting means and so on. Compared with the direct lighting apparatus, the indirect lighting apparatus mitigates to some degree the intensified light emitted from the LED and protects the eyes of users.

SUMMARY

One embodiment is a lighting device including:

a light source unit including a substrate and a light emitting diode disposed on the substrate;

a heat sink including an inner surface on which the light source unit is disposed and at least one opening; and a top plate being disposed on the heat sink and including a reflective surface which reflects light from the light source unit in a particular direction.

Another embodiment is a lighting device including:

a light source unit including a substrate and a light emitting diode disposed on the substrate;

a heat sink including an inner surface on which the substrate is disposed and an upper opening and a lower opening;

a top plate being disposed on the upper opening of the heat sink and including a reflective surface which is disposed in the interior space of the heat sink and has a predetermined inclination; and a safety plate being disposed under the lower opening of the heat sink and including an edge disposed between the light emitting device and the lowest portion of the reflective surface.

BRIEF DESCRIPTION OF THE DRAWINGS

Arrangements and embodiments may be described in detail with reference to the following drawings in which like reference numerals refer to like elements and wherein.

DETAILED DESCRIPTION

A thickness or a size of each layer may be magnified, omitted or schematically shown for the purpose of convenience and clearness of description. The size of each component may not necessarily mean its actual size.

It should be understood that when an element is referred to as being 'on' or "under" another element, it may be directly on/under the element, and/or one or more intervening elements may also be present. When an element is referred to as being 'on' or 'under', 'under the element' as well as 'on the element' may be included based on the element.

An embodiment may be described in detail with reference to the accompanying drawings.

Figure 1:
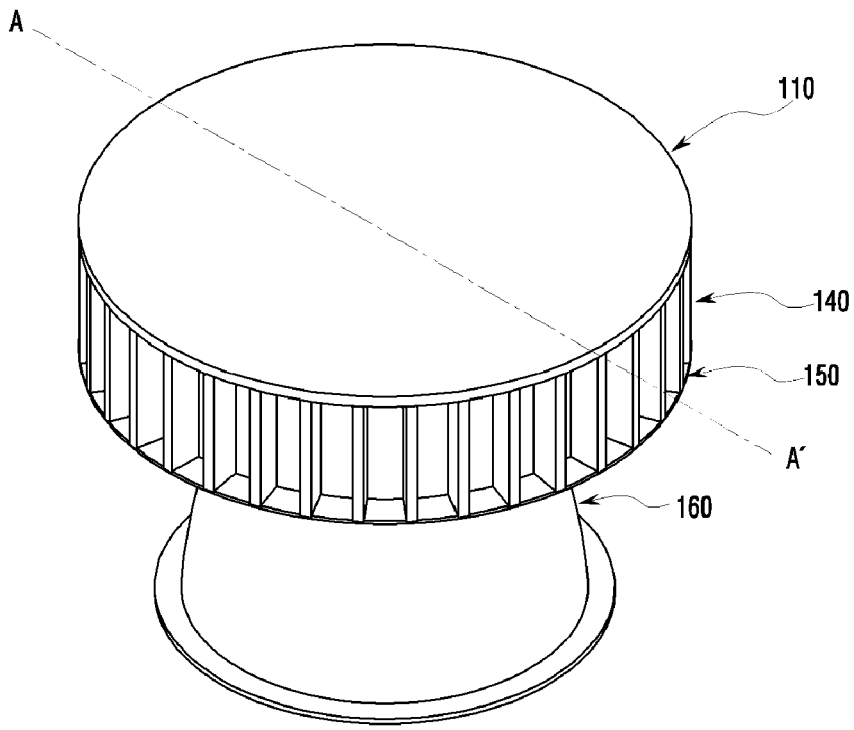
FIG. 1 is a perspective view of a lighting device according to an embodiment.
Figure 2:
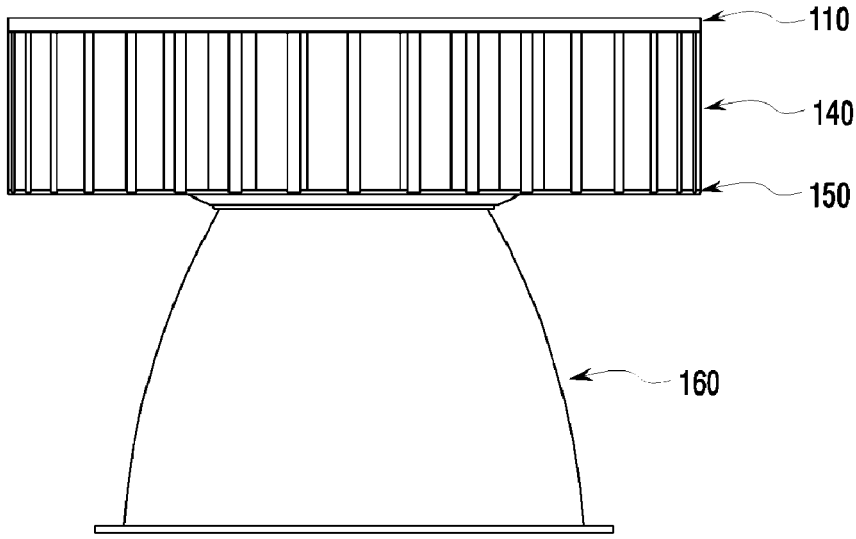
FIG. 2 is a front view of the lighting device shown in FIG. 1.
Figure 3:
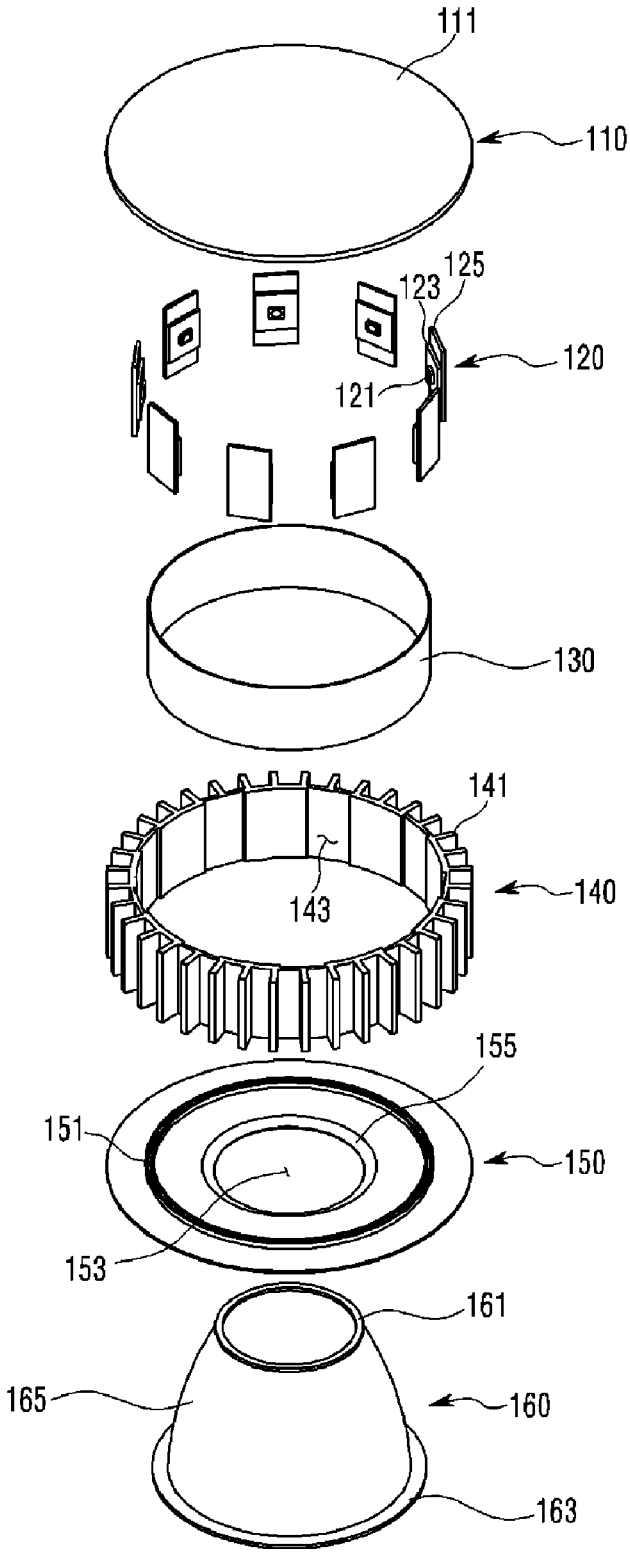
FIG. 3 is an exploded perspective view of the lighting device shown in FIG. 1.
Figure 4:
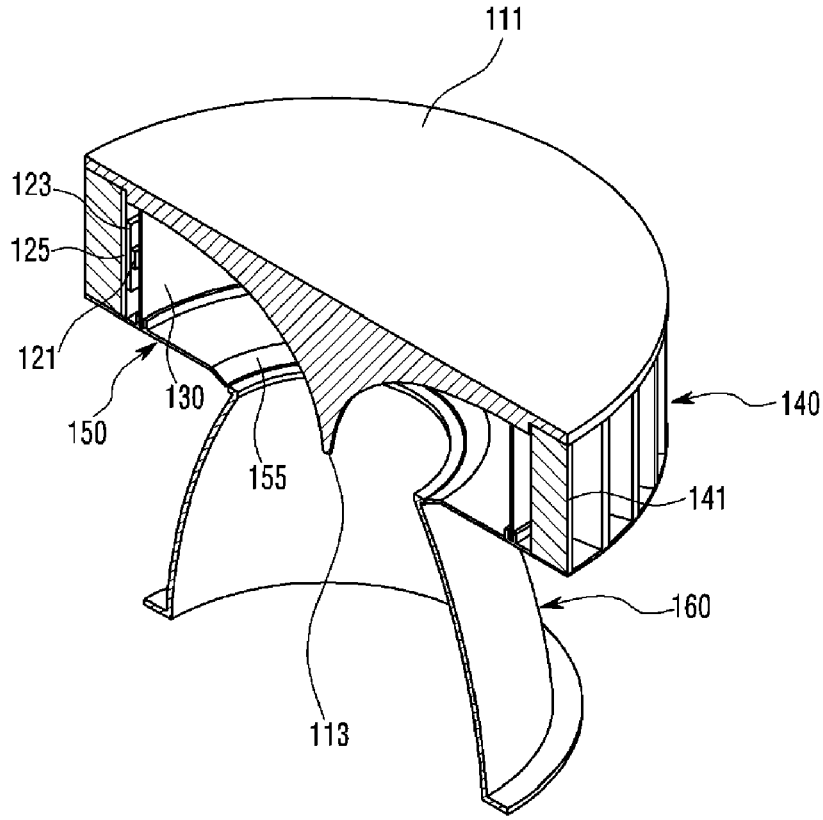
FIG. 4 is a sectional perspective view of the lighting device shown in FIG. 1.

FIG. 1 is a perspective view of a lighting device according to an embodiment. FIG. 2 is a front view of the lighting device shown in FIG. 1. FIG. 3 is an exploded perspective view of the lighting device shown in FIG. 1. FIG. 4 is a sectional perspective view of the lighting device shown in FIG. 1.

Referring to FIGS. 1 to 4, the lighting device according to the embodiment may include a top plate 110, a plurality of light source units 120, an optical body 130, a heat sink 140, a bottom plate 150 and a cover 160.

The top plate 110 covers an upper opening of the heat sink 140. The top plate 110 may include an outer surface 111 and an inner surface 113.

The outer surface 111 of the top plate 110 is flat.

The inner surface 113 of the top plate 110 may be a reflective surface for reflecting incident light from the plurality of the light source units 120 in a particular direction. More specifically, the inner surface 113 of the top plate 110 may be, as shown in FIG. 4, a reflective surface having a conical shape. Here, the conical shape includes not only a geometrically perfect cone but a cone of which the reflective surface is curved in a direction of the center of the top plate 110, and also includes a cone of which the reflective surface is curved in the outward direction.

When the top plate 110 covers the upper opening of the heat sink 140, the reflective surface 113 is located in the interior space of the heat sink 140. Here, the structure of the reflective surface 113 will be described with reference to FIG. 5.

Figure 5:
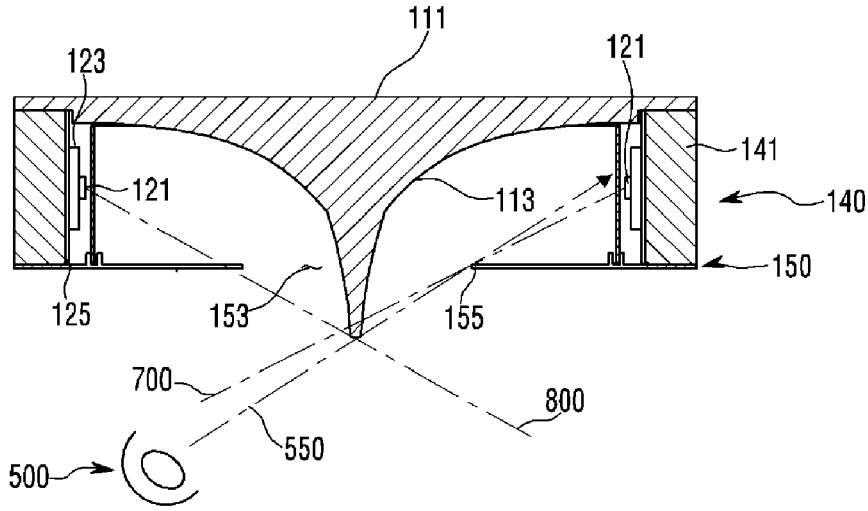
FIG. 5 is a partial cross sectional view of the lighting device shown in FIG. 1.

FIG. 5 is a partial cross sectional view of the lighting device shown in FIG. 4.

Referring to FIG. 5, the reflective surface 113 may penetrate through a light emitting opening 153 of the bottom plate 150. However, without being limited to this, the reflective surface 113 may not through the light emitting opening.

When a portion of the reflective surface 113 is disposed to penetrate through the light emitting opening 153 of the bottom plate 150, it is possible to protect a user's eyes 500 from the light source unit 120. Since a line 550 of sight of a user's eyes 500 is blocked by the portion of the reflective surface 113 penetrating through the light emitting opening of the bottom plate 150, the user cannot directly see the light source unit 120.

Specifically, in a case where an edge 155 defining the light emitting opening 153 of the bottom plate 150 is designed in advance and the light source unit 120 is disposed on the inner surface of the heat sink 140 in advance, when a portion of the reflective surface 113 passes through an imaginary line 700 connecting an LED 121 of the light source unit 120 with the edge 155 of the bottom plate 150, the user cannot directly see strong light which directly passes through the light emitting opening 153 of the bottom plate 150 instead of traveling toward the reflective surface 113 among light emitted from the light source unit 120.

Meanwhile, even when the light source unit 120 is disposed in advance on the inner surface of the heat sink 140, when the reflective surface 113 of the top plate 110 is installed in advance and when the edge 155 of the bottom plate 150 is disposed at a particular position, the user's eyes 500 can be protected. Specifically, either when the edge 155 of the bottom plate 150 passes through an imaginary line 800 connecting the lowest portion of the reflective surface 113 with the LED 121 of the light source unit 120, or when the edge 155 of the bottom plate 150 is located between the lowest portion of the reflective surface 113 and the LED 121 of the light source unit 120, the user cannot directly see the LED 121 of the light source unit 120.

As such, in the lighting device according to the embodiment, the reflective surface 113 of the top plate 110 and the edge 155 of the bottom plate 150 as a safety plate are placed as described above, the user's eyes can protect be protected.

The light source unit 120 will be described again with reference to FIGS. 1 to 4. The light source unit 120 includes the LED 121 and a substrate 123 on which the LED 121 is mounted.

The light source unit 120 may further include a heat sink plate 125 disposed between one side of the substrate 123 and the heat sink 140. One side of the heat sink plate 125 contacts with the other side of the substrate 123. The other side of the heat sink plate 125 contacts with the inner surface of the heat sink 140. Therefore, the heat sink plate 125 is able to efficiently transfer heat from the LED 121 to the heat sink 140.

The heat sink plate 125 has a structure capable of being mounted on the inner surface of the heat sink 140. Specifically, the heat sink plate 125 has a structure capable of being inserted into a seating recess 143 of the inner curved surface of the heat sink 140.

The plurality of the light source units 120 are mounted on the inner curved surface of the heat sink 140. Therefore, the plurality of the light source units 120 are arranged according to the shape of the inner curved surface of the heat sink 140. In the figures, since the heat sink 140 has an empty cylindrical shape, the plurality of the light source units 120 are arranged in the form of a circle. The plurality of the light source units 120 emit light toward the center of the cylindrical heat sink 140.

The optical body 130 may be disposed between the reflective surface 113 of the top plate 110 and the plurality of the light source units 120 of the heat sink 140.

The optical body 130 can convert blue light emitted from the plurality of the light source units 120 into white light. In this case, the optical body 130 may be a photo luminescent film (PLF) including at least one fluorescent material. Here, the PLF converts incident light into white light by increasing the color rendering index (CRI) of the incident light.

The optical body 130 can diffuse the white light emitted from the plurality of the light source units 120. In this case, the optical body 130 may be a diffusion plate including a diffusing agent.

The optical body 130 as the PLF or the diffusion plate may have an empty cylindrical shape having an upper opening and a lower opening in accordance with the shape of the heat sink 140.

The optical body 130 may be inserted into a fixing recess 151 of the bottom plate 150. When the lower portion of the optical body 130 is inserted into the 151 of the bottom plate 150, the optical body 130 may be fixed and mounted on the interior space of the heat sink 140.

The optical body 130 has an empty cylindrical shape having an upper opening and a lower opening and may include an outer surface and an inner surface.

A plurality of heat radiating fins 141 are connected with the outer surface of the 140. Otherwise, each of the plurality of the 141 may extend outwardly from the outer surface of the heat sink 140.

The plurality of the 120 are mounted on the inner surface, i.e., the inner curved surface of the heat sink 140. For this purpose, the seating recess 143 into which each of the plurality of the light source units 120 is inserted is formed in the inner surface of the heat sink 140. More description thereof will be provided with reference to FIG. 6.

Figure 6:
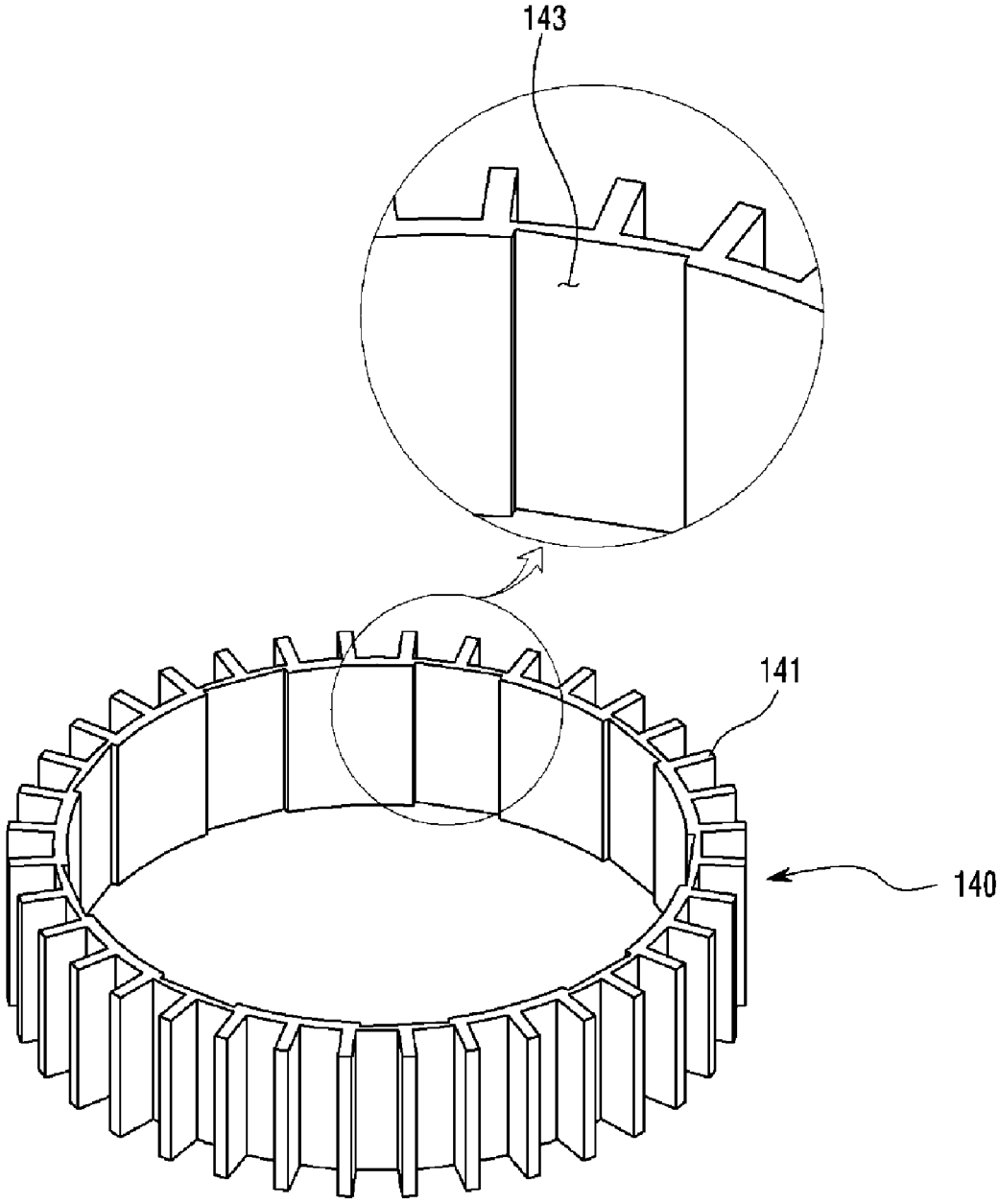
FIG. 6 is a perspective view of the heat sink shown in FIG. 3.

FIG. 6 is a perspective view of the heat sink shown in FIG. 3;

Referring to FIG. 6, the inner curved surface of the heat sink 140 has a plurality of the seating recesses 143 of which the number corresponds to that of the light source units 120.

The plurality of the seating recesses 143 may be disposed separately from each other at a certain interval on the inner curved surface of the heat sink 140.

The bottom surface of the seating recess 143 may be flat in order to come in surface contact with the substrate 123 of the light source unit 120 or one side of the heat sink plate 125. When the bottom surface of the seating recess 143 is flat, the bottom surface of the seating recess 143 is able to easily come in surface contact with the substrate 123 of the light source unit 120 or the heat sink plate 125, so that the seating recess 143 can effectively receive the heat from the LED 121 of the light source unit 120. Here, the bottom surface of the seating recess 143 may follow the shape of the substrate 123 of the light source unit 120 or the shape of the heat sink plate 125 instead of being flat.

Again, referring to FIGS. 1 to 4, the upper opening of the heat sink 140 is hermetically sealed by the top plate 110. The lower opening of the heat sink 140 is partly hermetically sealed by the bottom plate 150.

The optical body 130 and the reflective surface 113 of the top plate 110 are disposed in the interior space of the heat sink 140. Here, the interior space of the heat sink 140 corresponds to an empty space defined by the inner surface of the heat sink 140, the top plate 110 and the bottom plate 150.

The bottom plate 150 can function as a safety plate.

The bottom plate 150 is disposed on a light emission path. Specifically, the bottom plate 150 is disposed in the lower opening and may have a flat plate shape.

The bottom plate 150 includes the fixing recess 151 into which the optical body 130 is inserted. When the lower portion of the optical body 130 is inserted into the fixing recess 151, the optical body 130 is disposed and fixed in the interior space of the heat sink 140.

The bottom plate 150 includes the light emitting opening 153 through which light reflected by the reflective surface 113 of the top plate 110 passes. The light emitting opening 153 is defined by the edge 155. Hereafter, various modified examples of the bottom plate 150 will be described with reference to the accompanying drawings.

Figure 7:
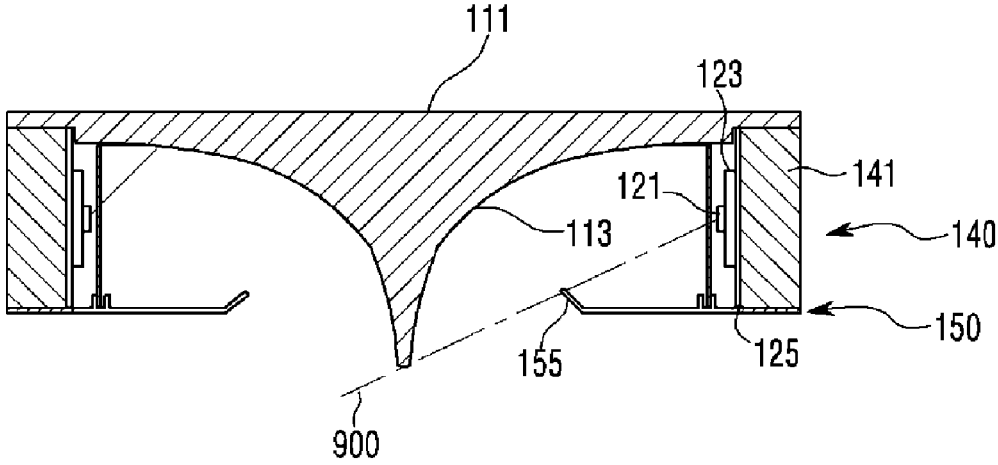
FIG. 7 is a cross sectional view for describing another embodiment of the bottom plate.

FIG. 7 is a cross sectional view for describing another embodiment of the bottom plate.

Referring to FIG. 7, the edge 155 of the bottom plate 150 may be inclined toward the interior space of the heat sink 140. When the edge 155 of the bottom plate 150 is inclined, the user's eyes can be protected. Specifically, in a case where the reflective surface 113 of the top plate 110 is fixed and the light source unit 120 is mounted on the inner curved surface of the heat sink 140, when the edge 155 of the bottom plate 150 is disposed on an imaginary line 900 connecting the lowest portion of the reflective surface 113 with the LED 121 of the light source unit 120 or passes through the imaginary line 900, the user cannot directly see the LED 121 of the light source unit 120 mounted on the inner curved surface of the heat sink 140.

Figure 8:
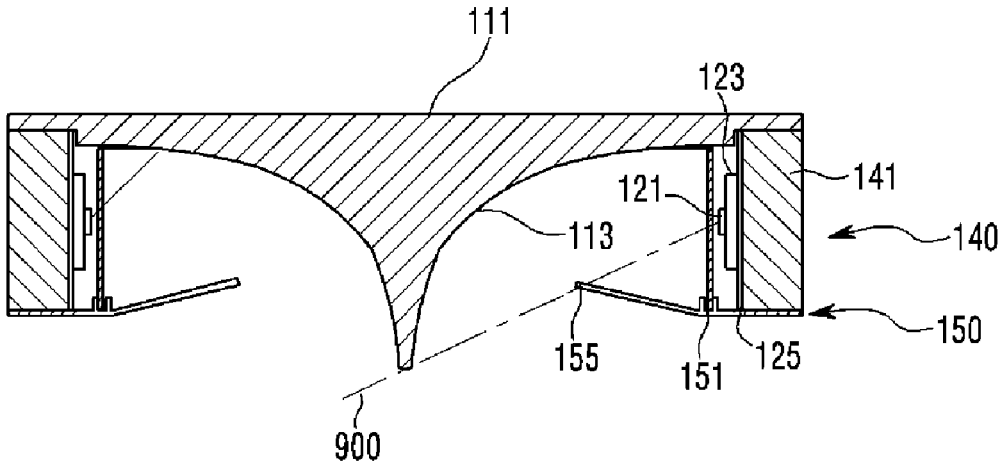
FIG. 8 is a cross sectional view for describing another embodiment of the bottom plate.

FIG. 8 is a cross sectional view for describing further another embodiment of the bottom plate.

Referring to FIG. 8, a portion of the bottom plate 150 may be inclined toward the interior space of the heat sink 140. Here, the portion of the bottom plate 150 may correspond to a portion from the edge 155 of the bottom plate 150 to the fixing recess 151 of the bottom plate 150. In also FIG. 8, since the edge 155 of the bottom plate 150 is disposed on or passes through the imaginary line 900, the user's eyes can be protected.

Again, referring to FIGS. 1 to 4, the inner surface of the bottom plate 150 may include an inclined surface. This will be described in detail with reference to the accompanying FIG. 9.

Figure 9:
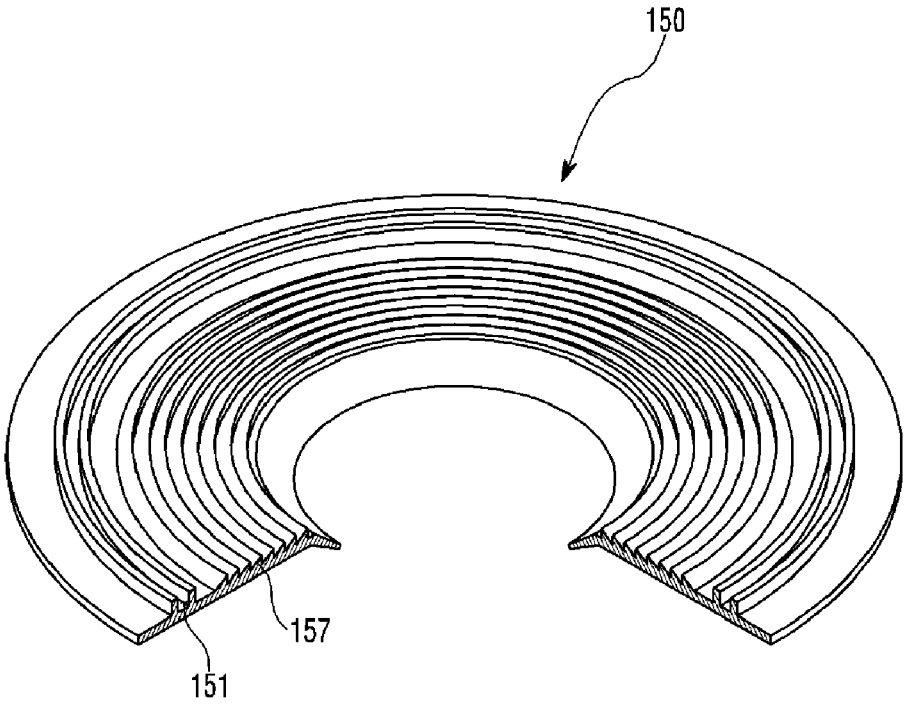
FIG. 9 is a perspective view for describing another embodiment of the bottom plate shown in FIG. 3.

FIG. 9 is a perspective view for describing another embodiment of the bottom plate shown in FIG. 3.

Referring to FIG. 9, the bottom plate 150 may include at least one inclined surface 157. The inclined surfaces 157 may be disposed between the fixing recess 151 and the edge 155 in the inner surface of the bottom plate 150.

The inclined surface 157 has a predetermined angle in such a manner as to face the light source unit 120 shown in FIG. 3. The inclined surfaces 157 may be disposed to form a concentric circle based on the circular array of the light source unit 120. The plurality of the inclined surfaces 157 may be disposed to form a concentric circle.

The inclined surface 157 can reflect light, which is not directly incident on the reflective surface 113 of the top plate 110 from the LED 121 of the light source unit 120 but directly incident on the reflective surface of the bottom plate 150, to the inner surface 113 of the top plate 110. Thanks to the inclined surface 157, luminous efficiency of the lighting device according to the embodiment can be improved.

While FIG. 9 shows that a plurality of the inclined surfaces 157 have the same inclination, they can have mutually different inclinations. When the plurality of the inclined surfaces 157 have the mutually different inclinations, even if the light emitted from the LED 121 of the light source unit 120 is incident on any position of the inner surface of the bottom plate 150, the light incident on the plurality of the inclined surfaces 157 can be reflected to a particular position of the reflective surface 113 of the top plate 110. Therefore, the plurality of the inclined surfaces 157 having the mutually different inclinations can provide more improved luminous efficiency than the inclined surfaces 157 having the same inclination.

Again, referring to FIGS. 1 to 4, the cover 160 collects the light which has passed through the light emitting opening 153 of the bottom plate 150. The cover 160 may include an upper portion 161, a lower portion 163 and a light collector 165.

The upper portion 161 of the cover 160 defines an upper opening of the cover 160 and has a structure that can be coupled to the edge 155 of the bottom plate 150. Specifically, this will be described with reference to FIGS. 10 to 12.

Figure 10:
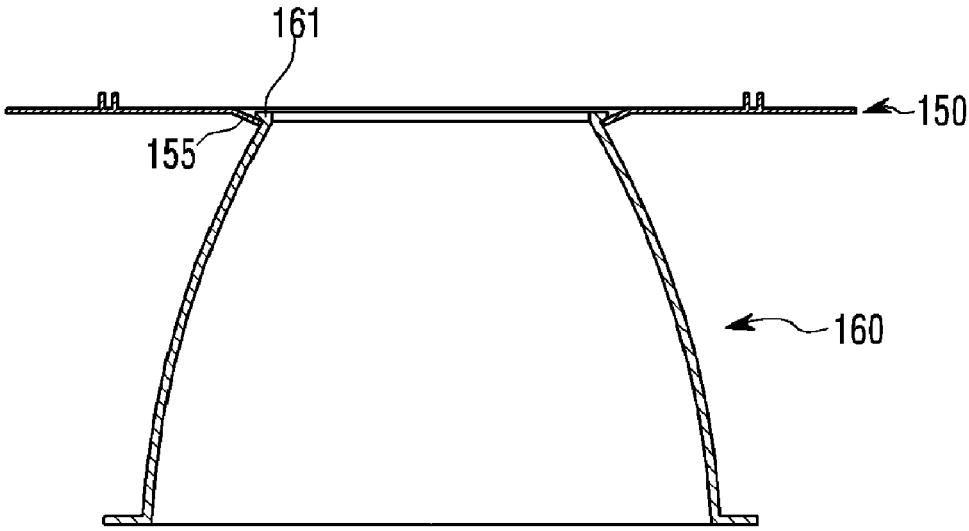
FIG. 10 is a cross sectional view showing a state where the bottom plate shown in FIG. 3 has been coupled to the cover shown in FIG. 3.
Figure 11:
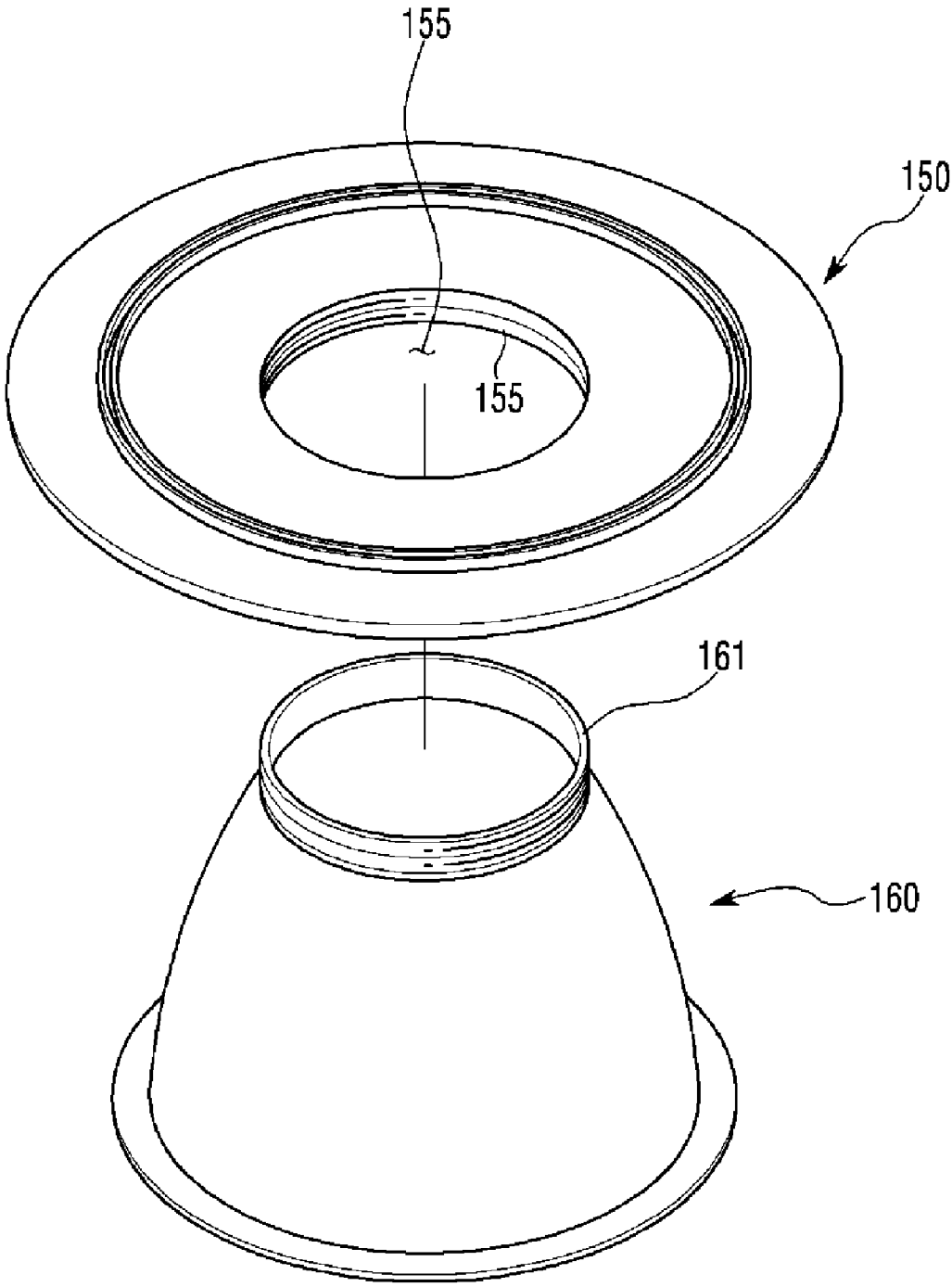
FIG. 11 is an exploded perspective view of the bottom plate shown in FIG. 3 and the cover shown in FIG. 3.
Figure 12:
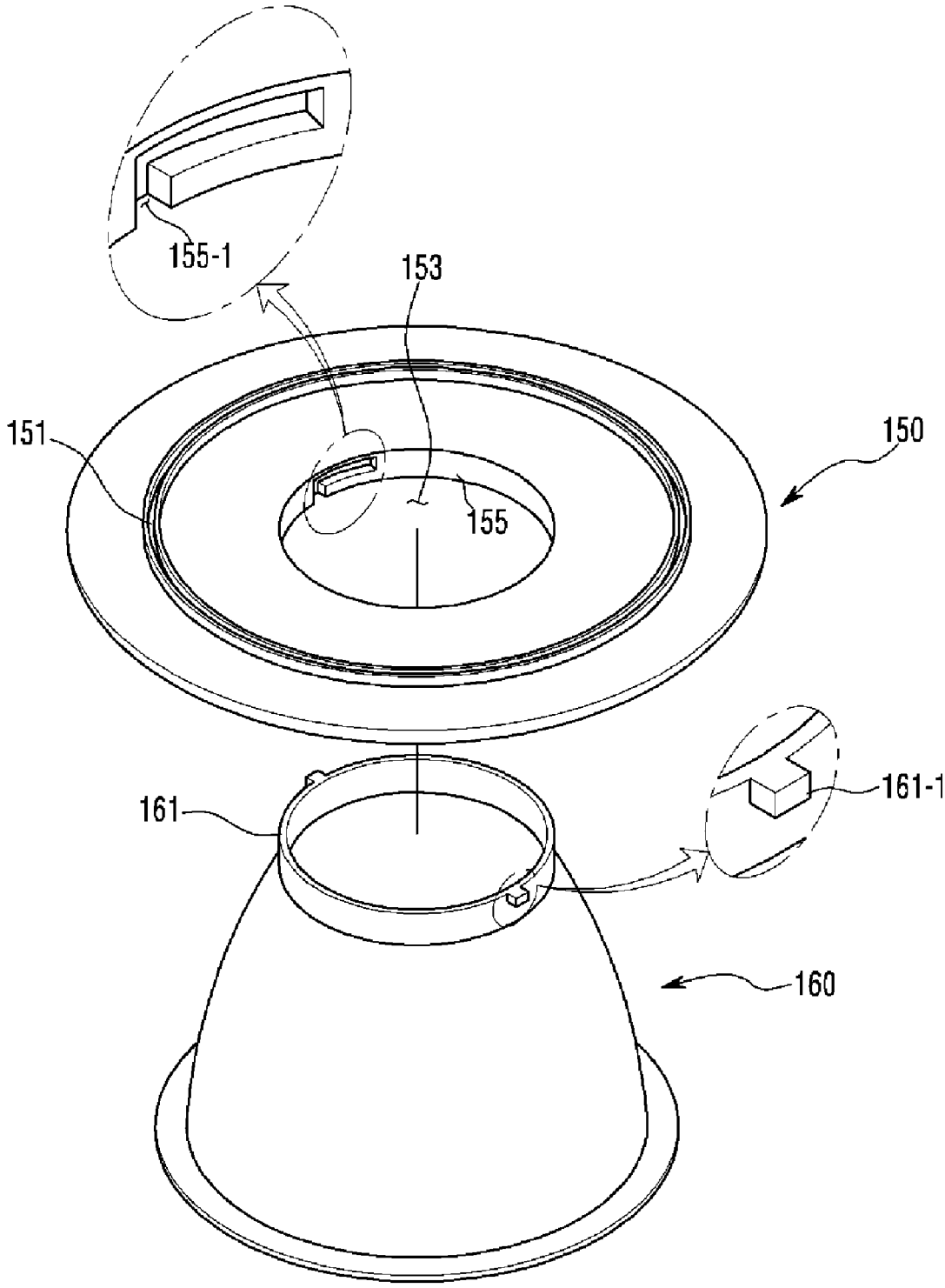
FIG. 12 is an exploded perspective view of the bottom plate shown in FIG. 3 and the cover shown in FIG. 3.

FIG. 10 is a cross sectional view showing a state where the bottom plate shown in FIG. 3 has been coupled to the cover shown in FIG. 3. FIG. 11 is an exploded perspective view showing a structure in which the bottom plate shown in FIG. 3 can be coupled to the cover shown in FIG. 3. FIG. 12 is an exploded perspective view showing another structure in which the bottom plate shown in FIG. 3 can be coupled to the cover shown in FIG. 3.

Referring to FIG. 10, the upper portion 161 of the cover 160 comes in contact with the edge 155 of the bottom plate 150 and is mounted on the light emitting opening 153 of the bottom plate 150. The upper portion 161 of the cover 160 is caught by the edge 155 of the bottom plate 150, so that the cover 160 can be coupled to the bottom plate 150. The cover 160 is made of a flexible material such as rubber, an elastic metal or a nonconductive material in order that the upper portion 161 of the cover 160 may be caught by the edge 155 of the bottom plate 150. When the cover 160 is made of the flexible material, the upper portion 161 of the cover 160 can be inserted into the light emitting opening 153 of the bottom plate 150 by an external pressure. In addition, when the external pressure is removed after inserting the upper portion 161 of the cover 160 into the light emitting opening 153 of the bottom plate 150, the upper portion 161 of the cover 160 recovers to its initial state. As a result, the cover 160 can be strongly coupled to the bottom plate 150. When the cover 160 is made of the flexible material, it is easy to separate the cover 160 from the bottom plate 150, so that maintenance can be easily done.

Referring to FIG. 11, for the purpose of coupling the cover 160 to the bottom plate 150, the upper portion 161 of the cover 160 may include a spiral protrusion, and the edge 155 of the bottom plate 150 may include a spiral recess corresponding to the spiral protrusion. The spiral protrusion of the upper portion 161 of the cover 160 is inserted into the spiral recess of the edge 155 of the bottom plate 150, so that the cover 160 can be coupled to the bottom plate 150. In this case, when the cover 160 is turned in a reverse direction to the coupling direction of the cover 160 and the bottom plate 150, the cover 160 is easily separated from the bottom plate 150.

Referring to FIG. 12, for the purpose of coupling the cover 160 to the bottom plate 150, the upper portion 161 of the cover 160 may include at least one protrusion 161-1, and the edge 155 of the bottom plate 150 may include an angled recess 155-1 to which the protrusion 161-1 is inserted and fixed.

The angled recess 155-1 of the edge 155 of the bottom plate 150 includes a longitudinal recess and a crosswise recess.

After the protrusion 161-1 of the cover 160 inserted into the longitudinal recess of the angled recess 155-1, the cover 160 is turned clockwise. Then the protrusion 161-1 of the cover 160 moves along the crosswise recess, so that the cover 160 is coupled to the bottom plate 150. Meanwhile, the cover 160 is separated from the bottom plate 150 by turning the cover 160 counterclockwise and moving down.

Again, referring to FIGS. 1 to 4, the lower portion 163 of the cover 160 defines a lower opening of the cover 160. The width of the lower opening of the lower portion 163 may be greater than the width of the upper opening of the upper portion 161. Therefore, the lower opening of the cover 160 may be larger than the upper opening of the cover 160. The cover 160 will be described in detail with reference to FIG. 13.

Figure 13:
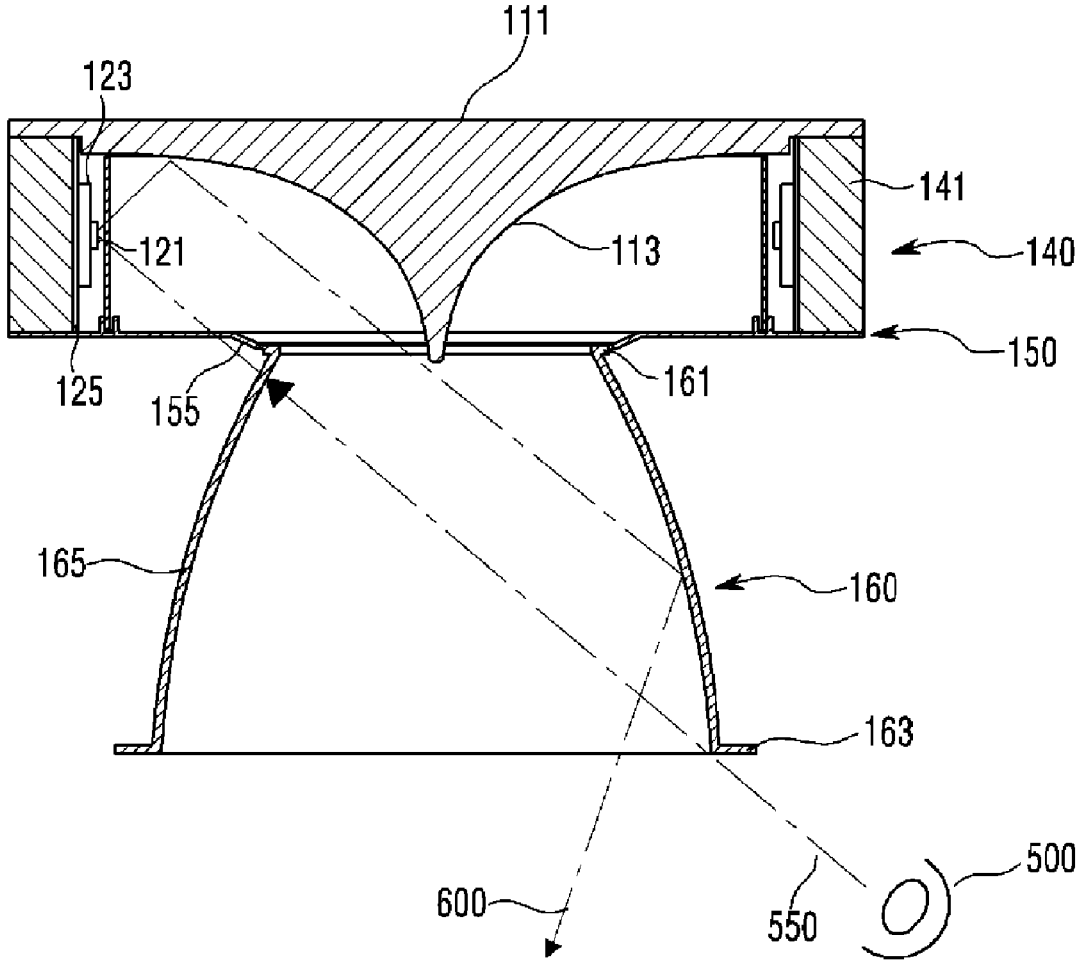
FIG. 13 is a cross sectional view of the lighting device shown in FIG. 1.

FIG. 13 is a cross sectional view of the lighting device shown in FIG. 1.

Referring to FIG. 13, the light collector 165 of the cover 160 connects the upper portion 161 with the lower portion 163 and collects light emitted through the light emitting opening 153 of the bottom plate 150. For this purpose, the light collector 165 may have a shape curved in the outward direction of the cover 160.

Among the lights emitted through the light emitting opening 153 of the bottom plate 150, the light collector 165 of the cover 160 functions to reflect light 600, which forms a large angle with a light emitting direction, in the light emitting direction. Therefore, a light reflective material layer may be disposed on the inner surface of the light collector 165.

The cover 160 does not allow a user to directly see the plurality of the light source units 120 through the lower opening of the lower portion 163 of the cover 160 and protects the user's eyes 500. Specifically, in a case where the bottom plate 150 and the reflective surface 113 of the top plate 110 are disposed in advance and the cover 160 is not provided, a user can directly see the LED 121 of the light source unit 120 through the light emitting opening 153 of the bottom plate 150 if there are no structures shown in FIGS. 5, 7 and 8 on the bottom plate 150. However, as shown in FIG. 13, when the upper portion 161 of the light collector 165 of the cover 160 is located between the lower portion 163 of the cover 160 and the LED 121 of the light source unit 120, the line 550 of sight of a user's eyes 500 is limited by the upper portion 161 or the inner surface of the light collector 165 even though the line 550 of sight of the user's eyes passes through the lower opening of the cover 160. Therefore, the user cannot directly see the LED 121 of the light source unit 120, so that the user's eyes can be protected.

The upper portion 161 of the cover 160 may be disposed between a certain point defining the lower opening of the lower portion 163 of the cover 160 and the LED 121 of the light source unit 120 which is the farthest away from the point.

Figure 14:
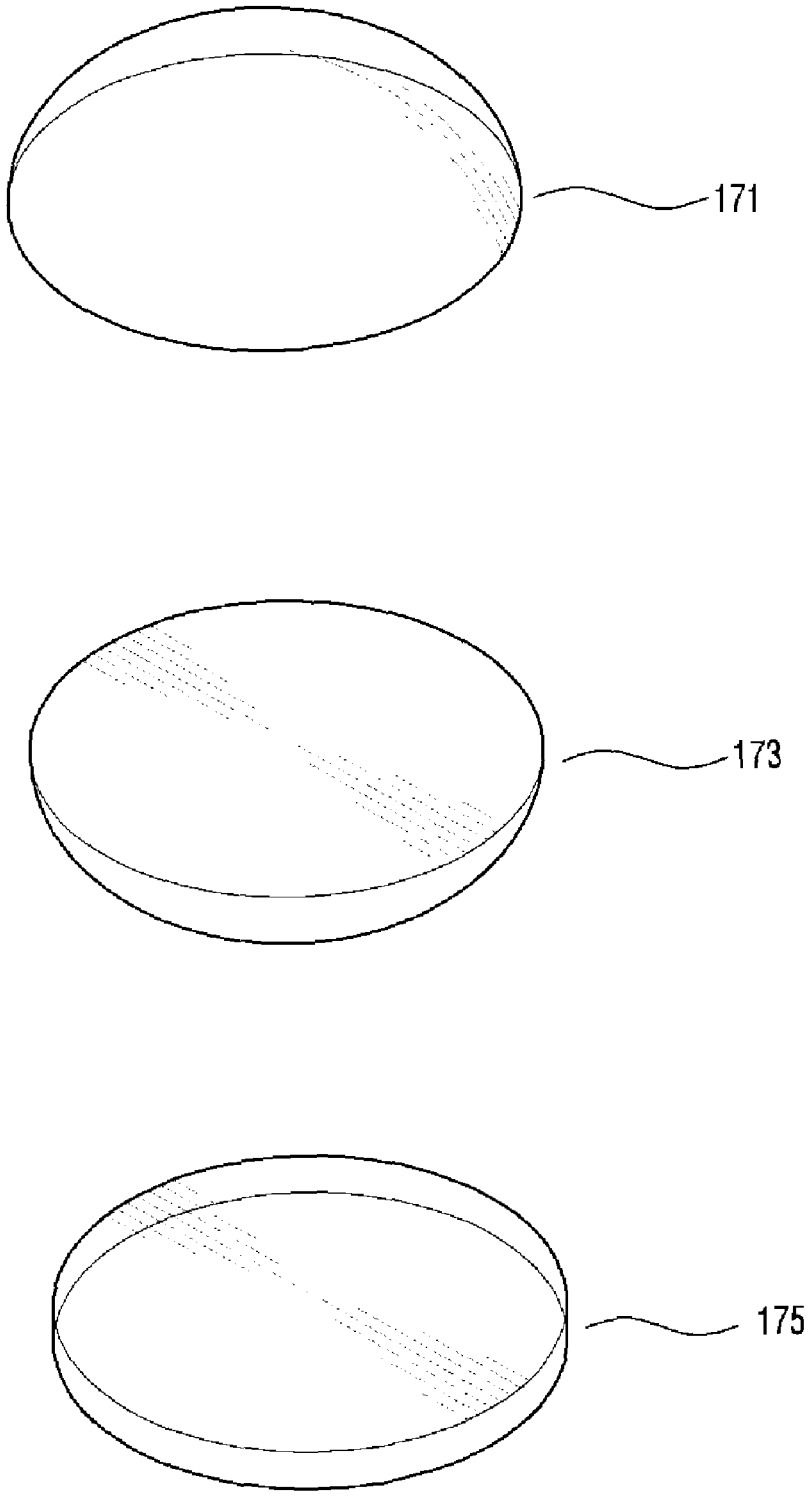
FIG. 14 is a perspective view showing other examples of the lens.

FIG. 14 is a perspective view showing other examples of the lens. Various lenses 171, 173 and 175 shown in FIG. 14 can be respectively installed in the light emitting opening 153 of the bottom plate 150 shown in FIG. 3. When the lenses 171, 173 and 175 are installed in the light emitting opening 153 of the bottom plate 150, they can optically convert the lights emitted from the LED 121 of the light source unit 120. For example, light incident on the light emitting opening 153 of the bottom plate 150 may be diffused or collected.

The first lens 171 shown in the top part of the FIG. 14 has a hemispherical shape. The hemisphere of the first lens 171 faces the reflective surface 113 of the top plate 110.

The second lens 172 shown in the intermediate part of FIG. 14 has a hemispherical shape like the first lens 171. However, the hemisphere of the second lens 172 is disposed toward the lower opening of the cover 160.

The third lens 175 shown in the bottom part of FIG. 14 has a flat shape having a predetermined thickness. The third lens 175 includes a predetermined pattern therein and is able to diffuse or collect the incident light. Further, the third lens 175 includes at least one fluorescent material therein and is able to excite the incident light.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting device comprising:

a light source unit including a substrate and a light emitting diode disposed on the substrate;

a heat sink including an inner surface on which the light source unit is disposed and at least one opening; a top plate being disposed on the heat sink and including a reflective surface which reflects light from the light source unit in a particular direction; and a bottom plate disposed under the heat sink;

wherein the bottom plate comprises an inclined surface for reflecting light incident from the light source unit to the reflective surface of the top plate wherein the at least one opening of the heat sink comprises an upper opening and a lower opening, the top plate is disposed on the upper opening, the bottom plate is disposed under the lower opening, and the bottom plate further comprises a light emitting opening through which the light reflected by the reflective surface of the top plate passes and an edge defining the light emitting opening.

2. The lighting device of claim 1, wherein a plurality of the light source units are provided, and wherein the plurality of the light source units are disposed separately from each other on the inner surface of the heat sink.

3. The lighting device of claim 1, wherein the inner surface of the heat sink comprises a seating recess on which the substrate is disposed.

4. The lighting device of claim 3, wherein the inner surface of the heat sink is curved and a bottom surface of the seating recess is flat.

5. The lighting device of claim 1, further comprising a heat sink plate disposed between one side of the substrate and the inner surface of the heat sink.

6. The lighting device of claim 1, wherein the heat sink has a cylindrical shape having the inner surface and an outer surface, and wherein a plurality of heat radiating fins are disposed on the outer surface of the heat sink.

7. The lighting device of claim 1, comprising an optical body which is disposed between the heat sink and the reflective surface of the top plate and excites, diffuses or collects light from the light source unit.

8. The lighting device of claim 7, wherein the bottom plate comprises a fixing recess receiving one end of the optical body.

9. The lighting device of claim 1, wherein the reflective surface of the top plate has a conical shape.

10. The lighting device of claim 1, wherein the edge of the bottom plate is disposed between a lowest portion of the reflective surface and the light emitting diode.

11. The lighting device of claim 1, wherein a plurality of the inclined surfaces are provided, and wherein the plurality of the inclined surfaces have mutually different inclinations.

12. The lighting device of claim 1, further comprising a lens disposed on the light emitting opening of the bottom plate.

13. A lighting device comprising:

a light source unit comprising a substrate and a light emitting diode disposed on the substrate;

a heat sink including an inner surface on which the light source unit is disposed and at least one opening;

a top plate being disposed on the heat sink and including a reflective surface which reflects light from the light source unit in a particular direction;

a bottom plate disposed under the heat sink and having a light emitting opening and an edge defining the light emitting opening; and a cover disposed on the light emitting opening of the bottom plate, wherein the cover includes:

an upper portion coupled to an edge of the bottom plate;

a lower portion including an opening larger than the light emitting opening of the bottom plate; and a light collector being disposed between the upper portion and the lower portion and collecting the light wherein the at least one opening of the heat sink comprises an upper opening and a lower opening, the top plate is disposed on the upper opening, the bottom plate is disposed under the lower opening, and the light reflected by the reflective surface of the top plate passes through the light emitting opening.

14. The lighting device of claim 13, wherein at least one of the upper portion or the lower portion is disposed on an imaginary line connecting a certain point defining an opening of the lower portion of the cover with the light emitting device of the light source unit which is the farthest away from the point.

15. The lighting device of claim 13, wherein a light reflective material layer is disposed on an inner surface of the light collector.

16. The lighting device of claim 13, wherein the edge of the bottom plate comprises a spiral recess or an angled recess, and wherein the upper portion of the cover comprises a protrusion inserted into the spiral recess or the angled recess.

17. The lighting device of claim 16, wherein the reflective surface has a conical shape.

18. A lighting device comprising:

a light source unit including a substrate and a light emitting diode disposed on the substrate;

a heat sink including an inner surface on which the substrate is disposed and an upper opening and a lower opening;

a top plate being disposed on the upper opening of the heat sink and including a reflective surface which is disposed in the interior space of the heat sink and has a predetermined inclination; and a safety plate being disposed under the lower opening of the heat sink and including an edge disposed between the light emitting device and the lowest portion of the reflective surface.

19. The lighting device of claim 18, wherein the safety plate comprises an inner surface, and wherein the inner surface of the safety plate has a predetermined inclination for reflecting light from the light emitting device to the reflective surface.

* * * * *